US012129535B2

(12) United States Patent
Kariya et al.

(10) Patent No.: US 12,129,535 B2
(45) Date of Patent: Oct. 29, 2024

(54) STEEL SHEET FOR CANS AND METHOD OF PRODUCING SAME

(71) Applicant: JFE STEEL CORPORATION, Tokyo (JP)

(72) Inventors: Nobusuke Kariya, Tokyo (JP); Fusae Shiimori, Tokyo (JP); Katsumi Kojima, Tokyo (JP); Daisuke Otani, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 619 days.

(21) Appl. No.: 17/415,733

(22) PCT Filed: Nov. 13, 2019

(86) PCT No.: PCT/JP2019/044589
§ 371 (c)(1),
(2) Date: Jun. 18, 2021

(87) PCT Pub. No.: WO2020/129482
PCT Pub. Date: Jun. 25, 2020

(65) Prior Publication Data

US 2022/0074031 A1 Mar. 10, 2022

(30) Foreign Application Priority Data

Dec. 20, 2018 (JP) ..... 2018-238544

(51) Int. Cl.

| | |
|---|---|
| ***C22C 38/22*** | (2006.01) |
| ***B21C 47/02*** | (2006.01) |
| ***C21D 8/02*** | (2006.01) |
| ***C21D 8/10*** | (2006.01) |
| ***C22C 38/00*** | (2006.01) |
| ***C22C 38/04*** | (2006.01) |
| ***C22C 38/06*** | (2006.01) |
| ***C22C 38/26*** | (2006.01) |
| ***C22C 38/28*** | (2006.01) |
| ***C22C 38/32*** | (2006.01) |

(52) U.S. Cl.
CPC ..... *C22C 38/22* (2013.01); *B21C 47/02* (2013.01); *C21D 8/0226* (2013.01); *C21D 8/0236* (2013.01); *C21D 8/105* (2013.01); *C22C 38/001* (2013.01); *C22C 38/002* (2013.01); *C22C 38/04* (2013.01); *C22C 38/06* (2013.01); *C22C 38/26* (2013.01); *C22C 38/28* (2013.01); *C22C 38/32* (2013.01); *C21D 2211/003* (2013.01); *C21D 2211/005* (2013.01)

(58) Field of Classification Search
None
See application file for complete search history.

(56) References Cited

U.S. PATENT DOCUMENTS

| | | | |
|---|---|---|---|
| 5,454,883 | A | 10/1995 | Yoshie et al. |
| 6,221,180 | B1 | 4/2001 | Tosaka et al. |
| 10,415,111 | B2 | 9/2019 | Tada et al. |
| 10,907,236 | B2 | 2/2021 | Oka et al. |
| 2010/0116832 | A1 | 5/2010 | Nishihara et al. |
| 2019/0367210 | A1 | 12/2019 | Smith |

FOREIGN PATENT DOCUMENTS

| | | | |
|---|---|---|---|
| CN | 1263568 | A | 8/2000 |
| CN | 1946866 | A | 4/2007 |
| CN | 101014727 | A | 8/2007 |
| CN | 104520461 | A | 4/2015 |
| CN | 104789866 | A | 7/2015 |
| CN | 106605006 | A | 4/2017 |
| CN | 107923013 | A | 4/2018 |
| CN | 108118248 | A | 6/2018 |
| EP | 1741800 | A1 | 1/2007 |
| EP | 1806420 | A1 | 7/2007 |
| EP | 2138596 | A1 | 12/2009 |
| EP | 2871255 | A1 | 5/2015 |
| EP | 3476964 | B1 | 1/2021 |
| JP | H08325670 | A | 12/1996 |
| JP | 2001089828 | A | 4/2001 |
| JP | 2004183074 | A | 7/2004 |
| JP | 2009132984 | A | 6/2009 |
| JP | 5858208 | B1 | 2/2016 |
| JP | 2016211047 | A | 12/2016 |
| JP | 2018059196 | A | 4/2018 |

(Continued)

OTHER PUBLICATIONS

Nov. 9, 2022, Office Action issued by the Korean Intellectual Property Office in the corresponding Korean Patent Application No. 10-2021-7018754 with English language concise statement of relevance.
Oct. 27, 2023, Office Action issued by the China National Intellectual Property Administration in the corresponding Chinese Patent Application No. 202211517205.8 with English language search report.
May 6, 2022, Office Action issued by the China National Intellectual Property Administration in the corresponding Chinese Patent Application No. 201980084585.0 with English language search report.
Wang Xuewu, Metal Materials and Heat Treatment, Jul. 31, 2018, p. 191.

(Continued)

*Primary Examiner* — Anthony M Liang
(74) *Attorney, Agent, or Firm* — KENJA IP LAW PC

(57) ABSTRACT

Provided is a steel sheet for cans. A steel sheet for cans comprises: a chemical composition containing, in mass %, C: 0.010% or more and 0.130% or less, Si: 0.04% or less, Mn: 0.10% or more and 1.00% or less, P: 0.007% or more and 0.100% or less, S: 0.0005% or more and 0.0090% or less, Al: 0.001% or more and 0.100% or less, N: 0.0050% or less, Ti: 0.0050% or more and 0.1000% or less, and Cr: 0.08% or less, and satisfying a relationship $0.005 \leq (Ti^*/48)/(C/12) \leq 0.700$ where $Ti^* = Ti - 1.5S$, with a balance consisting of Fe and inevitable impurities; a microstructure in which a proportion of cementite in ferrite grains is 10% or less; and an upper yield strength of 550 MPa or more.

2 Claims, No Drawings

(56) References Cited

FOREIGN PATENT DOCUMENTS

| | | | |
|---|---|---|---|
| KR | 1020090122366 | A | 11/2009 |
| KR | 1020170121277 | A | 11/2017 |
| WO | 2015166653 | A1 | 11/2015 |
| WO | 2016060248 | A1 | 4/2016 |
| WO | 2016157878 | A1 | 10/2016 |
| WO | 2018061787 | A1 | 4/2018 |
| WO | 2018136290 | A1 | 7/2018 |
| WO | 2018194135 | A1 | 10/2018 |

OTHER PUBLICATIONS

Wu Run et al., Steel quality and failure analysis of its components, Apr. 30, 2018, pp. 138-139.

Feb. 18, 2020, International Search Report issued in the International Patent Application No. PCT/JP2019/044589.

May 13, 2020, Office Action issued by the Taiwan Intellectual Property Office in the corresponding Taiwanese Patent Application No. 108144959 with English language Search Report.

Mar. 24, 2022, the Extended European Search Report issued by the European Patent Office in the corresponding European Patent Application No. 19900454.0.

Sep. 20, 2022, Office Action issued by the China National Intellectual Property Administration in the corresponding Chinese Patent Application No. 201980084585.0 with English language search report.

Lu Jinsheng et al., Handbook for X-Ray Identification of Common Phases in Steels and Alloys, Oct. 31, 1990, p. 8.

Liu Zhengdong, Design and Practice of Selective Strengthening of Heat Resistant Materials for Power Stations, Jan. 31, 2017, p. 14.

STEEL SHEET FOR CANS AND METHOD OF PRODUCING SAME

TECHNICAL FIELD

The present disclosure relates to a steel sheet for cans and a method of producing the same.

BACKGROUND

Steel sheets are used in the can bodies or lids of food cans and beverage cans. These cans are desired to be produced at lower costs.

Hence, reduction in the thickness of steel sheets used is promoted to reduce the material costs. Steel sheets subjected to thickness reduction include steel sheets used in the can body of a two-piece can formed by drawing, the can body of a three-piece can formed by cylinder forming, and their can lids. Since simply reducing the thickness of a steel sheet causes a decrease in the strength of the can body or the can lid, it is desirable to use a high-strength and ultra-thin steel sheet for cans in a part such as the can body of a drawn-redrawn (DRD) can or a welded can.

A high-strength and ultra-thin steel sheet for cans is produced using a double reduction method (hereafter also referred to as "DR method") that involves secondary cold rolling with a rolling reduction of 20% or more after annealing. A steel sheet (hereafter also referred to as "DR material") produced using the DR method has high strength, but has low total elongation (poor ductility) and poor workability.

DR materials are increasingly used in straight-shaped can bodies. Meanwhile, can lids of food cans which open have complex shapes, and therefore the use of DR materials often results in failure to obtain highly accurate shapes in sites that are complex in shape. Specifically, a can lid is produced by subjecting a steel sheet sequentially to blanking, shell processing, and curling by press working. In particular, given that a flange portion of a can body and a curl portion of a can lid are seamed to ensure the hermeticity of a can, the curl portion of the can lid needs to be shaped with high accuracy in curling. For example, if the curl portion of the can lid is wrinkled, the hermeticity of the can after seaming the flange portion of the can body and the curl portion of the can lid is significantly impaired. A DR material typically used as a high-strength and ultra-thin steel sheet for cans has poor ductility. It is often difficult to use such a DR material in a can lid of a complex shape from the viewpoint of workability. Hence, in the case of using a DR material, die adjustment is performed many times before yielding a product. The DR material is obtained by strengthening the steel sheet through strain hardening by secondary cold rolling. Depending on the accuracy of the secondary cold rolling, the strain hardening is non-uniformly introduced into the steel sheet, as a result of which local deformation occurs when working the DR material. Such local deformation causes wrinkling of the curl portion of the can lid, and thus needs to be prevented.

To avoid the drawbacks of the DR material, high-strength steel sheet production methods using various strengthening techniques are proposed. JP H8-325670 A (PTL 1) proposes a steel sheet that achieves a balance between strength and ductility by combining strengthening by precipitation of Nb carbide and refinement strengthening by Nb, Ti, and B carbonitrides. JP 2004-183074 A (PTL 2) proposes a method of strengthening a steel sheet using solid solution strengthening by Mn, P, N, etc. JP 2001-89828 A (PTL 3) proposes a steel sheet for cans that has a tensile strength of less than 540 MPa using strengthening by precipitation of Nb, Ti, and B carbonitrides and has improved weld formability by controlling the particle size of oxide-based inclusions. JP 5858208 B1 (PTL 4) proposes a steel sheet for high-strength containers that has high strength by solute N by increasing the N content and has a tensile strength of 400 MPa or more and an elongation after fracture of 10% or more by controlling the dislocation density of the steel sheet in the thickness direction.

CITATION LIST

Patent Literature

PTL 1: JP H8-325670 A
PTL 2: JP 2004-183074 A
PTL 3: JP 2001-89828 A
PTL 4: JP 5858208 B1

SUMMARY

Technical Problem

As mentioned above, the strength needs to be ensured in order to reduce the thickness of a steel sheet for cans. Meanwhile, in the case where the steel sheet is used as a material of a can lid having high working accuracy, the steel sheet needs to have high ductility. Further, to enhance the working accuracy of the curl portion of the can lid, local deformation of the steel sheet needs to be suppressed. Regarding these properties, the foregoing conventional techniques are inferior in any of the strength, the ductility (total elongation), the uniform deformability, and the curl portion working accuracy.

PTL 1 proposes a steel that has high strength by strengthening by precipitation and achieves a balance between strength and ductility. However, local deformation of the steel sheet is not taken into consideration in PTL 1. With the production method described in PTL 1, it is difficult to obtain a steel sheet that satisfies the working accuracy required for the curl portion of the can lid.

PTL 2 proposes achieving high strength by solid solution strengthening. However, strengthening the steel sheet by excessively adding P facilitates local deformation of the steel sheet, and it is difficult to obtain a steel sheet that satisfies the working accuracy required for the curl portion of the can lid.

PTL 3 proposes achieving desired strength by strengthening by precipitation of Nb, Ti, and B carbonitrides. However, from the viewpoint of weld formability and surface characteristics, Ca and REM need to be added, too, and there is a problem of degradation in corrosion resistance. Moreover, local deformation of the steel sheet is not taken into consideration in PTL 3. With the production method described in PTL 3, it is difficult to obtain a steel sheet that satisfies the working accuracy required for the curl portion of the can lid.

PTL 4 proposes forming a can lid using a steel sheet for high-strength containers that has a tensile strength of 400 MPa or more and an elongation after fracture of 10% or more and pressure resistance is evaluated for the can lid. However, the shape of the curl portion of the can lid is not taken into consideration, and it is difficult to obtain a can lid having high working accuracy.

It could therefore be helpful to provide a steel sheet for cans that has high strength and has sufficiently high working accuracy particularly as a material of a curl portion of a can lid, and a method of producing the same.

Solution to Problem

We thus provide:

[1] A steel sheet for cans, comprising: a chemical composition containing (consisting of), in mass %, C: 0.010% or more and 0.130% or less, Si: 0.04% or less, Mn: 0.10% or more and 1.00% or less, P: 0.007% or more and 0.100% or less, S: 0.0005% or more and 0.0090% or less, Al: 0.001% or more and 0.100% or less, N: 0.0050% or less, Ti: 0.0050% or more and 0.1000% or less, and Cr: 0.08% or less, and satisfying a relationship $0.005 \leq (Ti^*/48)/(C/12) \leq 0.700$ where $Ti^*=Ti-1.5S$, with a balance consisting of Fe and inevitable impurities; a microstructure in which a proportion of cementite in ferrite grains is 10% or less; and an upper yield strength of 550 MPa or more.

[2] The steel sheet for cans according to [1], wherein the chemical composition further contains, in mass %, one or more selected from Nb: 0.0050% or more and 0.0500% or less, Mo: 0.0050% or more and 0.0500% or less, and B: 0.0020% or more and 0.0100% or less.

[3] A method of producing a steel sheet for cans, the method comprising: performing a hot rolling process of heating a steel slab at 1200° C. or more, the steel slab having a chemical composition containing, in mass %, C: 0.010% or more and 0.130% or less, Si: 0.04% or less, Mn: 0.10% or more and 1.00% or less, P: 0.007% or more and 0.100% or less, S: 0.0005% or more and 0.0090% or less, Al: 0.001% or more and 0.100% or less, N: 0.0050% or less, Ti: 0.0050% or more and 0.1000% or less, and Cr: 0.08% or less, and satisfying a relationship $0.005 \leq (Ti^*/48)/(C/12) \leq 0.700$ where $Ti^*=Ti-1.5S$, with a balance consisting of Fe and inevitable impurities; rolling the steel slab at a finish rolling temperature of 850° C. or more to obtain a steel sheet, coiling the steel sheet at a temperature of 640° C. or more and 780° C. or less, and thereafter cooling the steel sheet at an average cooling rate from 500° C. to 300° C. of 25° C./h or more and 55° C./h or less, performing a primary cold rolling process of subjecting the steel sheet after the hot rolling process to cold rolling with a rolling reduction of 86% or more; performing an annealing process of heating the steel sheet after the primary cold rolling process at an average heating rate to 500° C. of 8 °C/s or more and 50° C./s or less, and thereafter holding the steel sheet in a temperature range of 640° C. or more and 780° C. or less for 10 sec or more and 90 sec or less; and performing a secondary cold rolling process of subjecting the steel sheet after the annealing process to cold rolling with a rolling reduction of 0.1% or more and 15.0% or less.

[4] The method of producing a steel sheet for cans according to [3], wherein the chemical composition further contains, in mass %, one or more selected from Nb: 0.0050% or more and 0.0500% or less, Mo: 0.0050% or more and 0.0500% or less, and B: 0.0020% or more and 0.0100% or less.

Advantageous Effect

It is thus possible to obtain a steel sheet for cans that has high strength and has sufficiently high working accuracy particularly as a material of a curl portion of a can lid.

DETAILED DESCRIPTION

One of the disclosed embodiments will be described below. First, the chemical composition of a steel sheet for cans according to one of the disclosed embodiments will be described below. Although the unit in the chemical composition is "mass %", the unit is simply expressed as "%" unless otherwise noted.

C: 0.010% or More and 0.130% or Less

It is important that the steel sheet for cans according to this embodiment has an upper yield strength of 550 MPa or more. To achieve this, it is important to use strengthening by precipitation of Ti-based carbide formed as a result of Ti being contained. The C content in the steel sheet for cans is crucial in order to use strengthening by precipitation of Ti-based carbide. If the C content is less than 0.010%, the strength increase effect by the strengthening by precipitation decreases, resulting in an upper yield strength of less than 550 MPa. The lower limit of the C content is therefore 0.010%. If the C content is more than 0.130%, hypoperitectic cracking occurs in a cooling process during steelmaking. In addition, the steel sheet becomes excessively hard, and the ductility decreases. Furthermore, the proportion of cementite in ferrite grains exceeds 10%, and wrinkling occurs when the steel sheet is worked into a curl portion of a can lid. The upper limit of the C content is therefore 0.130%. If the C content is 0.060% or less, the deformation resistance in cold rolling is low, and rolling can be performed at a higher rolling rate. Hence, from the viewpoint of ease of production, the C content is preferably 0.015% or more, and the C content is preferably 0.060% or less.

Si: 0.04% or Less

Si is an element that increases the strength of the steel by solid solution strengthening. To achieve this effect, the Si content is preferably 0.01% or more. If the Si content is more than 0.04%, the corrosion resistance decreases significantly. The Si content is therefore 0.04% or less. The Si content is preferably 0.01% or more. The Si content is preferably 0.03% or less.

Mn: 0.10% or More and 1.00% or Less

Mn increases the strength of the steel by solid solution strengthening. If the Mn content is less than 0.10%, an upper yield strength of 550 MPa or more cannot be ensured. The lower limit of the Mn content is therefore 0.10%. If the Mn content is more than 1.00%, the corrosion resistance and the surface characteristics degrade. Moreover, the proportion of cementite in ferrite grains exceeds 10%, so that local deformation occurs and the uniform deformability decreases. The upper limit of the Mn content is therefore 1.00%. The Mn content is preferably 0.20% or more. The Mn content is preferably 0.60% or less.

P: 0.007% or More and 0.100% or Less

P is an element having high solid solution strengthening ability. To achieve this effect, the P content needs to be 0.007% or more. The lower limit of the P content is therefore 0.007%. If the P content is more than 0.100%, the steel sheet becomes excessively hard, so that the ductility decreases. Further, the corrosion resistance decreases. The upper limit of the P content is therefore 0.100%. The P content is preferably 0.008% or more. The P content is preferably 0.015% or less.

S: 0.0005% or More and 0.0090% or Less

The steel sheet for cans according to this embodiment has high strength as a result of strengthening by precipitation of Ti-based carbide. S tends to form TiS with Ti. In the case where TiS forms, the amount of Ti-based carbide useful for strengthening by precipitation decreases, and high strength cannot be achieved. In detail, if the S content is more than 0.0090%, a large amount of TiS forms, and the strength decreases. The upper limit of the S content is therefore 0.0090%. The S content is preferably 0.0080% or less. If the S content is less than 0.0005%, the desulfurization costs are excessively high. The lower limit of the S content is therefore 0.0005%.

Al: 0.001% or More and 0.100% or Less

Al is an element contained as a deoxidizer. Al is also useful for refining the steel. If the Al content is less than 0.001%, its effect as a deoxidizer is insufficient, and solidification defects occur and the steelmaking costs increase. The lower limit of the Al content is therefore 0.001%. If the Al content is more than 0.100%, surface defects may occur. The upper limit of the Al content is therefore 0.100% or less. To enable Al to sufficiently function as a deoxidizer, the Al content is preferably 0.010% or more, and the Al content is preferably 0.060% or less.

N: 0.0050% or Less

The steel sheet for cans according to this embodiment has high strength as a result of strengthening by precipitation of Ti-based carbide. N tends to form TiN with Ti. In the case where TiN forms, the amount of Ti-based carbide useful for strengthening by precipitation decreases, and high strength cannot be achieved. Moreover, if the N content is excessively high, slab cracking tends to occur in a lower straightening zone in which the temperature during continuous casting decreases. Further, the amount of Ti-based carbide useful for strengthening by precipitation decreases due to TiN formed in a large amount as mentioned above, and the desired strength cannot be achieved. The upper limit of the N content is therefore 0.0050%. Although no lower limit is placed on the N content, the N content is preferably more than 0.0005% from the viewpoint of steelmaking costs.

Ti: 0.0050% or More and 0.1000% or Less

Ti is an element having high carbide formability, and is effective in causing fine carbide to precipitate. This increases the upper yield strength. In this embodiment, the upper yield strength can be adjusted by adjusting the Ti content. This effect is achieved if the Ti content is 0.0050% or more. The lower limit of the Ti content is therefore 0.0050%. Meanwhile, Ti causes an increase in recrystallization temperature. If the Ti content is more than 0.1000%, a large amount of non-recrystallized microstructure remains in annealing at a soaking temperature of 640° C. to 780° C. In such a case, when the steel sheet deforms, strain is non-uniformly applied to the steel sheet. Thus, wrinkling occurs when the steel sheet is worked into a curl portion of a can lid. The upper limit of the Ti content is therefore 0.1000%. The Ti content is preferably 0.0100% or more. The Ti content is preferably 0.0800% or less.

Cr: 0.08% or Less

Cr is an element that forms carbonitride. Cr carbonitride contributes to higher strength of the steel, although its strengthening ability is lower than that of Ti-based carbide. To sufficiently achieve this effect, the Cr content is preferably 0.001% or more. If the Cr content is more than 0.08%, Cr carbonitride forms excessively, and the formation of Ti-based carbide that contributes most to the steel strengthening ability is reduced, making it impossible to achieve the desired strength. The Cr content is therefore 0.08% or less.

$$0.005 \leq (Ti^*/48)/(C/12) \leq 0.700$$

To achieve high strength and also suppress local deformation during working, the value of (Ti*/48)/(C/12) is important. Here, Ti* is defined as Ti*=Ti−1.5S. Ti forms a fine precipitate (Ti-based carbide) with C, and contributes to higher strength of the steel. C which does not form Ti-based carbide will end up being present in the steel as cementite or solute C. If the fraction of such cementite in the ferrite grains of the steel is not less than a predetermined fraction, local deformation occurs when working the steel sheet. Thus, wrinkling occurs when the steel sheet is worked into a curl portion of a can lid. Moreover, Ti tends to combine with S and form TiS. In the case where TiS forms, the amount of Ti-based carbide useful for strengthening by precipitation decreases, and high strength cannot be achieved. We discovered that, by controlling the value of (Ti*/48)/(C/12), wrinkling caused by local deformation when working the steel sheet can be suppressed while achieving strengthening by Ti-based carbide. In detail, if (Ti*/48)/(C/12) is less than 0.005, the amount of Ti-based carbide contributing to higher strength of the steel decreases, resulting in an upper yield strength of less than 550 MPa. Moreover, the proportion of cementite in ferrite grains exceeds 10%, and wrinkling occurs when the steel sheet is worked into a curl portion of a can lid. (Ti*/48)/(C/12) is therefore 0.005 or more. If (Ti*/48)/(C/12) is more than 0.700, a large amount of non-recrystallized microstructure remains in annealing at a soaking temperature of 640° C. to 780° C. In such a case, when the steel sheet deforms, strain is non-uniformly applied to the steel sheet. Thus, wrinkling occurs when the steel sheet is worked into a curl portion of a can lid. (Ti*/48)/(C/12) is therefore 0.700 or less. (Ti*/48)/(C/12) is preferably 0.090 or more. (Ti*/48)/(C/12) is preferably 0.400 or less.

The basic components according to this embodiment have been described above. While the balance other than the components described above consists of Fe and inevitable impurities, the chemical composition may optionally further contain the following elements as appropriate.

Nb: 0.0050% or More and 0.0500% or Less

Nb is an element having high carbide formability, and is effective in causing fine carbide to precipitate, as with Ti. This increases the upper yield strength. In this embodiment, the upper yield strength can be adjusted by adjusting the Nb content. This effect is achieved if the Nb content is 0.0050% or more. The lower limit of the Nb content is therefore 0.0050%. Meanwhile, Nb causes an increase in recrystallization temperature. If the Nb content is more than 0.0500%, a large amount of non-recrystallized microstructure remains in annealing at a soaking temperature of 640° C. to 780° C. In such a case, when the steel sheet deforms, strain is non-uniformly applied to the steel sheet. Thus, wrinkling occurs when the steel sheet is worked into a curl portion of a can lid. The upper limit of the Nb content is therefore 0.0500%. The Nb content is preferably 0.0080% or more. The Nb content is preferably 0.0300% or less.

Mo: 0.0050% or More and 0.0500% or Less

Mo is an element having high carbide formability, and is effective in causing fine carbide to precipitate, as with Ti and Nb. This increases the upper yield strength. In this embodiment, the upper yield strength can be adjusted by adjusting the Mo content. This effect is achieved if the Mo content is 0.0050% or more. The lower limit of the Mo content is therefore 0.0050%. Meanwhile, Mo causes an increase in recrystallization temperature. If the Mo content is more than 0.0500%, a large amount of non-recrystallized microstructure remains in annealing at a soaking temperature of 640° C. to 780° C. In such a case, when the steel sheet deforms, strain is non-uniformly applied to the steel sheet. Thus, wrinkling occurs when the steel sheet is worked into a curl portion of a can lid. The upper limit of the Mo content is therefore 0.0500%. The Mo content is preferably 0.0080% or more. The Mo content is preferably 0.0300% or less.

B: 0.0020% or More and 0.0100% or Less

B is effective in refining ferrite grains and increasing the upper yield strength. In this embodiment, the upper yield strength can be adjusted by adjusting the B content. This effect is achieved if the B content is 0.0020% or more. The lower limit of the B content is therefore 0.0020%. Meanwhile, B causes an increase in recrystallization temperature. If the B content is more than 0.0100%, a large amount of non-recrystallized microstructure remains in annealing at a soaking temperature of 640° C. to 780° C. In such a case, when the steel sheet deforms, strain is non-uniformly applied to the steel sheet. Thus, wrinkling occurs when the steel sheet is worked into a curl portion of a can lid. The upper limit of the B content is therefore 0.0100%. The B content is preferably 0.0025% or more. The B content is preferably 0.0050% or less.

The mechanical properties of the steel sheet for cans according to this embodiment will be described below. To ensure the denting strength of a welded can, the pressure resistance of a can lid, and the like, the upper yield strength of the steel sheet is limited to 550 MPa or more. If the composition is such that the upper yield strength is 670 MPa or less, higher corrosion resistance is achieved. The upper yield strength is therefore preferably 670 MPa or less.

The yield strength can be measured by the metallic material tensile testing method defined in JIS Z 2241: 2011. The foregoing yield strength can be achieved by adjusting the chemical composition, the cooling rate after coiling in a hot rolling process, and the heating rate in an annealing process. Specifically, a yield strength of 550 MPa or more can be achieved by limiting the chemical composition as described above, limiting the coiling temperature in the hot rolling process to 640° C. or more and 780° C. or less, limiting the average cooling rate from 500° C. to 300° C. after the coiling to 25° C./h or more and 55° C./h or less, limiting the average heating rate to 500° C. in the continuous annealing process to 8° C./s or more and 50° C./s or less, limiting the soaking temperature to 640° C. or more and 780° C. or less, limiting the holding time during which the soaking temperature is 640° C. to 780° C. to 10 sec or more and 90 sec or less, and limiting the rolling reduction in a secondary cold rolling process to 0.1% or more.

The metallic microstructure of the steel sheet for cans according to this embodiment will be described below.

Proportion of Cementite in Ferrite Grains: 10% or Less

If the proportion of cementite in ferrite grains is more than 10%, wrinkling is caused by local deformation during working, e.g. when the steel sheet is worked into a curl portion of a can lid. The proportion of cementite in ferrite grains is therefore 10% or less. Although the mechanism for this is not clear, it is presumed that, if cementite larger than fine Ti-based carbide is present in a large amount, the balance of interaction between dislocations and fine Ti-based carbide and cementite during working is lost, leading to wrinkling. The proportion of cementite in ferrite grains is preferably 8% or less. The proportion of cementite in ferrite grains is preferably 1% or more, and more preferably 2% or more.

The proportion of cementite in ferrite grains can be measured by the following method: After polishing a section in the thickness direction parallel to the rolling direction of the steel sheet, the section is etched with an etching solution (3 vol % nital). After this, a region from a position of ¼ of the thickness (i.e. a position of ¼ of the thickness from the surface in the thickness direction in the section) to a position of ½ of the thickness is observed using an optical microscope for 10 observation fields with 400 magnification. Using each micrograph taken by the optical microscope, cementite in ferrite grains is identified through visual determination, and the area ratio of cementite is calculated through image analysis. Here, cementite is circular and elliptic metallic microstructures in black or gray color in the optical microscope with 400 magnification. The area ratio of cementite is calculated for each observation field, and an average value of the area ratios for the 10 observation fields is taken to be the proportion of cementite in ferrite grains.

Thickness: 0.4 mm or Less

Currently, thinner steel sheets are promoted for the purpose of reducing can production costs. However, making a steel sheet thinner, i.e. reducing the thickness of the steel sheet, may cause a decrease in can strength and a forming failure during working. With the steel sheet for cans according to this embodiment, a decrease in can strength, e.g. a decrease in the pressure resistance of the can lid, and a forming failure involving wrinkling during working are prevented even in the case where the steel sheet is thin. That is, in the case where the steel sheet is thin, high strength and high working accuracy which are effects according to the present disclosure can be exhibited remarkably. Accordingly, the thickness is preferably 0.4 mm or less. The thickness may be 0.3 mm or less, and may be 0.2 mm or less.

A method of producing a steel sheet for cans according to one of the disclosed embodiments will be described below. In the following description, each temperature is based on the surface temperature of the steel sheet, and the average cooling rate is a value calculated based on the surface temperature of the steel sheet as follows: For example, the average cooling rate from 500° C. to 300° C. is expressed as "{(500° C.)−(300° C.)}/(cooling time from 500° C. to 300° C.)".

When producing the steel sheet for cans according to this embodiment, molten steel is adjusted to the foregoing chemical composition by a publicly known method using a converter or the like and then subjected to, for example, continuous casting to obtain a slab.

Slab Heating Temperature: 1200° C. or More

If the slab heating temperature in the hot rolling process is less than 1200° C., coarse nitride formed during the casting, such as AlN, remains in the steel as undissolved. This causes a decrease in can productivity. In such a case, when the steel sheet deforms, strain is non-uniformly applied to the steel sheet. Thus, wrinkling occurs when the steel sheet is worked into a curl portion of a can lid. The lower limit of the slab heating temperature is therefore 1200° C. The slab heating temperature is preferably 1220° C. or more. If the slab heating temperature is more than 1350° C., the effect is saturated. Accordingly, the upper limit of the slab heating temperature is preferably 1350° C.

Finish Rolling Temperature: 850° C. or More

If the finish temperature in the hot rolling process is less than 850° C., non-recrystallized microstructure resulting from non-recrystallized microstructure in the hot-rolled steel sheet remains in the steel sheet after the annealing, and wrinkling is caused by local deformation when working the steel sheet. The lower limit of the finish rolling temperature is therefore 850° C. If the finish rolling temperature is 950° C. or less, a steel sheet having better surface characteristics can be produced. Accordingly, the finish rolling temperature is preferably 950° C. or less.

Coiling Temperature: 640° C. or More and 780° C. or Less

If the coiling temperature in the hot rolling process is less than 640° C., a large amount of cementite precipitates in the hot-rolled steel sheet. Consequently, the proportion of cementite in ferrite grains after the annealing exceeds 10%, and wrinkling is caused by local deformation when the steel sheet is worked into a curl portion of a can lid. The lower limit of the coiling temperature is therefore 640° C. If the coiling temperature is more than 780° C., part of ferrite in the steel sheet after the continuous annealing coarsens and the steel sheet softens, resulting in an upper yield strength of less than 550 MPa. The upper limit of the coiling temperature is therefore 780° C. The coiling temperature is preferably 660° C. or more. The coiling temperature is preferably 760° C. or less.

Average Cooling Rate from 500° C. to 300° C.: 25° C./h or More and 55° C./h or Less If the average cooling rate from 500° C. to 300° C. after the coiling is less than 25° C./h, a large amount of cementite precipitates in the hot-rolled steel sheet, and the proportion of cementite in ferrite grains after the annealing exceeds 10%. Consequently, wrinkling is caused by local deformation when the steel sheet is worked into a curl portion of a can lid, or the amount of fine Ti-based carbide contributing to higher strength decreases and the strength of the steel sheet decreases. The lower limit of the average cooling rate from 500° C. to 300° C. after the coiling is therefore 25° C./h. If the average cooling rate from 500° C. to 300° C. after the coiling is more than 55° C./h, solute C present in the steel increases, and wrinkling is caused by solute C when the steel sheet is worked into a curl portion of a can lid. The upper limit of the average cooling rate from 500° C. to 300° C. after the coiling is therefore 55° C./h or less. The average cooling rate from 500° C. to 300° C. after the coiling is preferably 30° C./h or more. The average cooling rate from 500° C. to 300° C. after the coiling is preferably 50° C./h or less. The average cooling rate can be achieved by air cooling. Herein, the "average cooling rate" is based on the average temperature of the edges and the center in the coil transverse direction.

Pickling

After this, pickling is preferably performed according to need. The conditions of the pickling are not limited as long as surface layer scale can be removed. Scale may be removed by a method other than pickling.

Next, cold rolling is performed twice, with annealing being provided therebetween.

Rolling Reduction in Primary Cold Rolling: 86% or More

If the rolling reduction in the primary cold rolling process is less than 86%, strain applied to the steel sheet in the cold rolling decreases, making it difficult to achieve an upper yield strength of 550 MPa or more in the steel sheet after the continuous annealing. The rolling reduction in the primary cold rolling process is therefore 86% or more. The rolling reduction in the primary cold rolling process is preferably 87% or more. The rolling reduction in the primary cold rolling process is preferably 94% or less. One or more other processes, such as an annealing process for softening the hot-rolled sheet, may be performed as appropriate after the hot rolling process and before the primary cold rolling process. The primary cold rolling process may be performed immediately after the hot rolling process, without pickling.

Average Heating Rate to 500° C.: 8° C./s or More and 50° C./s or Less

The steel sheet after the primary cold rolling process is heated to the below-described soaking temperature under the condition that the average heating rate to 500° C. is 8° C./s or more and 50° C./s or less. If the average heating rate to 500° C. is less than 8° C./s, Ti-based carbide that precipitates mainly in the coiling process in the hot rolling coarsens during heating, and the strength decreases. The average heating rate to 500° C. is therefore 8° C./s or more. If the average heating rate to 500° C. is more than 50° C./s, a large amount of non-recrystallized microstructure remains in the annealing at a soaking temperature of 640° C. to 780° C. In such a case, when the steel sheet deforms, strain is non-uniformly applied to the steel sheet. Thus, wrinkling occurs when the steel sheet is worked into a curl portion of a can lid. The average heating rate to 500° C. is therefore 50° C./s or less. It is not preferable that the steel sheet temperature, after reaching 500° C., decreases before reaching the soaking temperature. The steel sheet is preferably heated to 640° C. while maintaining the average heating rate to 500° C.

Soaking Temperature: 640° C. or More and 780° C. or Less

If the soaking temperature in the continuous annealing process is more than 780° C., sheet passage troubles such as heat buckling are likely to occur in the continuous annealing. Moreover, part of ferrite grains in the steel sheet coarsens and the steel sheet softens, resulting in an upper yield strength of less than 550 MPa. The soaking temperature is therefore 780° C. or less. If the annealing temperature is less than 640° C., the recrystallization of ferrite grains is imperfect, and non-recrystallized microstructure remains. In the case where non-recrystallized microstructure remains, when the steel sheet deforms, strain is non-uniformly applied to the steel sheet, as a result of which local deformation occurs. Thus, wrinkling occurs when the steel sheet is worked into a curl portion of a can lid. The soaking temperature is therefore 640° C. or more. The soaking temperature is preferably 660° C. or more. The soaking temperature is preferably 740° C. or less.

Holding Time During which Soaking Temperature is in Temperature Range of 640° C. to 780° C.: 10 Sec or More and 90 Sec or Less If the holding time is more than 90 sec, Ti-based carbide that precipitates mainly in the coiling process in the hot rolling coarsens, and the strength decreases. If the holding time is less than 10 sec, the recrystallization of ferrite grains is imperfect, and non-recrystallized microstructure remains. Consequently, when the steel sheet deforms, strain is non-uniformly applied to the steel sheet, as a result of which local deformation occurs. Thus, wrinkling occurs when the steel sheet is worked into a curl portion of a can lid.

A continuous annealing device may be used in the annealing. One or more other processes, such as an annealing process for softening the hot-rolled sheet, may be performed as appropriate after the primary cold rolling process and before the annealing process. The annealing process may be performed immediately after the primary cold rolling process.

Rolling Reduction in Secondary Cold Rolling: 0.1% or More and 15.0% or Less

If the rolling reduction in the secondary cold rolling after the annealing is more than 15.0%, excessive strain hardening is introduced into the steel sheet, as a result of which the strength of the steel sheet increases excessively. Consequently, for example, cracking occurs in the shell processing for a can lid or wrinkling occurs in the subsequent working for a curl portion when working the steel sheet. The rolling reduction in the secondary cold rolling is therefore 15.0% or less. To enhance the accuracy of working the steel sheet, the secondary cold rolling ratio is desirably low. Hence, the rolling reduction in the secondary cold rolling is preferably less than 7.0%. The secondary cold rolling has a function of imparting surface roughness to the steel sheet. To impart uniform surface roughness to the steel sheet and achieve an upper yield strength of 550 MPa or more, the rolling reduction in the secondary cold rolling needs to be 0.1% or more. The secondary cold rolling process may be performed in an annealing device, or performed as an independent rolling process.

The steel sheet for cans according to this embodiment can be obtained in the above-described way. In this embodiment, various processes may be further performed after the secondary cold rolling. For example, a coating layer may be formed on the surface of the steel sheet for cans according to this embodiment. Examples of the coating layer include a Sn coating layer, a Cr coating layer as in tin-free steel, a Ni coating layer, and a Sn—Ni coating layer. Processes such as paint baking treatment and film lamination may also be performed. Since the film thickness of the coating, the laminate film, or the like is sufficiently small relative to the sheet thickness, its influence on the mechanical properties of the steel sheet for cans is negligible.

EXAMPLES

Each steel having the chemical composition shown in Table 1 with the balance consisting of Fe and inevitable impurities was obtained by steelmaking in a converter, and continuously cast to obtain a steel slab. The steel slab was then subjected to hot rolling under the hot rolling conditions shown in Table 2 and 3, and pickled after the hot rolling. The steel slab was then subjected to primary cold rolling with the rolling reduction shown in Table 2 and 3, subjected to continuous annealing under the continuous annealing conditions shown in Table 2 and 3, and then subjected to secondary cold rolling with the rolling reduction shown in Table 2 and 3, thus obtaining a steel sheet. The steel sheet was subjected to typical Sn coating continuously, to obtain a Sn coated steel sheet (tinned sheet-iron) with a coating weight per side of 11.2 g/m2. After this, the Sn coated steel sheet was subjected to heat treatment equivalent to paint baking treatment at 210° C. for 10 min, and then evaluated as follows.

<Tensile Test>

A tensile test was conducted in accordance with the metallic material tensile testing method defined in JIS Z 2241: 2011. In detail, a JIS No. 5 tensile test piece (JIS Z 2201) with the direction orthogonal to the rolling direction being the tensile direction was collected, and a parallel portion of the tensile test piece was provided with gauge marks of 50 mm (L). A tensile test conforming to JIS Z 2241 was then conducted at a tensile rate of 10 mm/min until the tensile test piece fractured, and the upper yield strength was measured. The measurement results are shown in Tables 2 and 3.

<Examination of Metallic Microstructure>

After polishing a section in the thickness direction parallel to the rolling direction of the Sn coated steel sheet, the section was etched with an etching solution (3 vol % nital). After this, a region from a position of ¼ of the thickness (i.e. a position of ¼ of the thickness from the surface in the thickness direction in the section) to a position of ½ of the thickness was observed using an optical microscope for 10 observation fields with 400 magnification. Using each micrograph taken by the optical microscope, cementite in ferrite grains was identified through visual determination, and the area ratio of cementite was calculated through image analysis. Here, cementite is circular and elliptic metallic microstructures in black or gray color in the optical microscope with 400 magnification. The area ratio of cementite was calculated for each observation field, and an average value of the area ratios for the 10 observation fields was taken to be the proportion of cementite in ferrite grains. For the image analysis, image analysis software ("Particle Analysis" available from Nippon Steel Technology Co., Ltd.) was used. The examination results are shown in Tables 2 and 3.

<Corrosion Resistance>

A region of a measurement area of 2.7 $mm^2$ in the Sn coated steel sheet was observed using an optical microscope with 50 magnification, and the number of hole-shaped sites as a result of the Sn coating thinning was counted. The corrosion resistance was evaluated as excellent in the case where the number of hole-shaped sites was less than 20, evaluated as good in the case where the number of hole-shaped sites was 20 or more and 25 or less, and evaluated as poor in the case where the number of hole-shaped sites was more than 25. The observation results are shown in Tables 2 and 3.

<Wrinkling>

A square blank of 120 mm was collected from the steel sheet, and sequentially subjected to circular blanking, shell processing, and curling to produce a can lid. The curl portion of the produced can lid was observed at eight locations in the circumferential direction using a stereoscopic microscope (available from Keyence Corporation), and whether wrinkling occurred was studied. The evaluation results are shown in Tables 2 and 3. In the case where wrinkling occurred in at least one of the eight locations in the circumferential direction, the steel sheet was determined as "wrinkled". In the case where wrinkling did not occur in any of the eight locations in the circumferential direction, the steel sheet was determined as "not wrinkled".

TABLE 1

| Steel No. | C | Si | Mn | P | S | Al | N | Ti | Cr | Nb | Mo | B | (mass %) Remarks |
|---|---|---|---|---|---|---|---|---|---|---|---|---|---|
| 1 | 0.038 | 0.01 | 0.47 | 0.008 | 0.0051 | 0.048 | 0.0045 | 0.072 | 0.024 | tr. | tr. | tr. | Example |
| 2 | 0.124 | 0.01 | 0.43 | 0.010 | 0.0064 | 0.052 | 0.0049 | 0.065 | 0.038 | tr. | tr. | tr. | Example |
| 3 | 0.015 | 0.02 | 0.50 | 0.009 | 0.0047 | 0.044 | 0.0042 | 0.046 | 0.015 | tr. | tr. | tr. | Example |
| 4 | 0.044 | 0.02 | 0.46 | 0.011 | 0.0053 | 0.039 | 0.0044 | 0.050 | 0.036 | tr. | tr. | tr. | Example |
| 5 | 0.036 | 0.03 | 0.29 | 0.010 | 0.0045 | 0.046 | 0.0046 | 0.052 | 0.023 | tr. | tr. | tr. | Example |
| 6 | 0.047 | 0.02 | 0.94 | 0.009 | 0.0066 | 0.038 | 0.0037 | 0.018 | 0.052 | tr. | tr. | tr. | Example |
| 7 | 0.039 | 0.02 | 0.12 | 0.009 | 0.0044 | 0.051 | 0.0041 | 0.037 | 0.029 | tr. | tr. | tr. | Example |
| 8 | 0.042 | 0.01 | 0.58 | 0.010 | 0.0060 | 0.047 | 0.0038 | 0.043 | 0.035 | tr. | tr. | tr. | Example |
| 9 | 0.053 | 0.01 | 0.21 | 0.011 | 0.0052 | 0.043 | 0.0046 | 0.024 | 0.047 | tr. | tr. | tr. | Example |
| 10 | 0.040 | 0.01 | 0.45 | 0.009 | 0.0031 | 0.055 | 0.0036 | 0.069 | 0.032 | tr. | tr. | tr. | Example |
| 11 | 0.046 | 0.02 | 0.37 | 0.010 | 0.0069 | 0.039 | 0.0043 | 0.054 | 0.004 | tr. | tr. | tr. | Example |
| 12 | 0.044 | 0.02 | 0.50 | 0.009 | 0.0088 | 0.052 | 0.0035 | 0.068 | 0.026 | tr. | tr. | tr. | Example |
| 13 | 0.058 | 0.01 | 0.44 | 0.010 | 0.0053 | 0.027 | 0.0039 | 0.053 | 0.078 | tr. | tr. | tr. | Example |
| 14 | 0.012 | 0.01 | 0.53 | 0.011 | 0.0062 | 0.046 | 0.0043 | 0.017 | 0.037 | tr. | tr. | tr. | Example |
| 15 | 0.054 | 0.02 | 0.32 | 0.010 | 0.0055 | 0.058 | 0.0037 | 0.019 | 0.013 | tr. | tr. | tr. | Example |

TABLE 1-continued

| Steel No. | C | Si | Mn | P | S | Al | N | Ti | Cr | Nb | Mo | B | (mass %) Remarks |
|---|---|---|---|---|---|---|---|---|---|---|---|---|---|
| 16 | 0.068 | 0.01 | 0.46 | 0.011 | 0.0079 | 0.054 | 0.0035 | 0.014 | 0.019 | tr. | tr. | tr. | Example |
| 17 | 0.039 | 0.01 | 0.35 | 0.012 | 0.0011 | 0.042 | 0.0039 | 0.015 | 0.015 | tr. | tr. | tr. | Example |
| 18 | 0.020 | 0.01 | 0.24 | 0.012 | 0.0039 | 0.056 | 0.0049 | 0.020 | 0.027 | tr. | tr. | tr. | Example |
| 19 | 0.042 | 0.02 | 0.47 | 0.011 | 0.0054 | 0.043 | 0.0012 | 0.044 | 0.030 | tr. | tr. | tr. | Example |
| 20 | 0.029 | 0.01 | 0.39 | 0.010 | 0.0067 | 0.051 | 0.0048 | 0.038 | 0.016 | tr. | tr. | tr. | Example |
| 21 | 0.042 | 0.01 | 0.52 | 0.011 | 0.0045 | 0.049 | 0.0021 | 0.026 | 0.032 | tr. | tr. | tr. | Example |
| 22 | 0.036 | 0.02 | 0.41 | 0.012 | 0.0056 | 0.053 | 0.0037 | 0.086 | 0.029 | tr. | tr. | tr. | Example |
| 23 | 0.028 | 0.02 | 0.53 | 0.014 | 0.0037 | 0.055 | 0.0040 | 0.009 | 0.018 | tr. | tr. | tr. | Example |
| 24 | 0.051 | 0.01 | 0.45 | 0.011 | 0.0063 | 0.042 | 0.0043 | 0.078 | 0.024 | tr. | tr. | tr. | Example |
| 25 | 0.032 | 0.02 | 0.51 | 0.013 | 0.0034 | 0.056 | 0.0034 | 0.011 | 0.027 | tr. | tr. | tr. | Example |
| 26 | 0.043 | 0.01 | 0.37 | 0.009 | 0.0052 | 0.049 | 0.0045 | 0.037 | 0.041 | 0.034 | tr. | tr. | Example |
| 27 | 0.038 | 0.01 | 0.42 | 0.011 | 0.0067 | 0.053 | 0.0038 | 0.045 | 0.039 | 0.025 | tr. | 0.0026 | Example |
| 28 | 0.035 | 0.02 | 0.39 | 0.010 | 0.0049 | 0.038 | 0.0042 | 0.035 | 0.042 | tr. | 0.038 | tr. | Example |
| 29 | 0.041 | 0.01 | 0.43 | 0.008 | 0.0056 | 0.047 | 0.0046 | 0.038 | 0.027 | tr. | 0.042 | 0.0022 | Example |
| 30 | 0.052 | 0.01 | 0.41 | 0.011 | 0.0063 | 0.055 | 0.0069 | 0.041 | 0.038 | 0.038 | 0.021 | tr. | Example |
| 31 | 0.182 | 0.02 | 0.42 | 0.009 | 0.0060 | 0.037 | 0.0039 | 0.055 | 0.019 | tr. | tr. | tr. | Comparative Example |
| 32 | 0.149 | 0.01 | 0.36 | 0.010 | 0.0049 | 0.051 | 0.0044 | 0.047 | 0.035 | tr. | tr. | tr. | Comparative Example |
| 33 | 0.046 | 0.01 | 0.48 | 0.011 | 0.0198 | 0.049 | 0.0042 | 0.073 | 0.040 | tr. | tr. | tr. | Comparative Example |
| 34 | 0.044 | 0.02 | 0.45 | 0.012 | 0.0057 | 0.029 | 0.0038 | 0.064 | 0.116 | tr. | tr. | tr. | Comparative Example |
| 35 | 0.006 | 0.01 | 0.51 | 0.014 | 0.0056 | 0.042 | 0.0039 | 0.013 | 0.052 | tr. | tr. | tr. | Comparative Example |
| 36 | 0.009 | 0.03 | 0.39 | 0.011 | 0.0052 | 0.047 | 0.0042 | 0.015 | 0.037 | tr. | tr. | tr. | Comparative Example |
| 37 | 0.039 | 0.08 | 0.43 | 0.012 | 0.0064 | 0.053 | 0.0044 | 0.026 | 0.045 | tr. | tr. | tr. | Comparative Example |
| 38 | 0.047 | 0.01 | 1.54 | 0.001 | 0.0048 | 0.045 | 0.0040 | 0.032 | 0.019 | tr. | tr. | tr. | Comparative Example |
| 39 | 0.061 | 0.02 | 0.03 | 0.013 | 0.0055 | 0.049 | 0.0038 | 0.074 | 0.036 | tr. | tr. | tr. | Comparative Example |
| 40 | 0.058 | 0.02 | 0.47 | 0.132 | 0.0054 | 0.036 | 0.0039 | 0.038 | 0.027 | tr. | tr. | tr. | Comparative Example |
| 41 | 0.036 | 0.01 | 0.32 | 0.011 | 0.0071 | 0.061 | 0.0227 | 0.046 | 0.031 | tr. | tr. | tr. | Comparative Example |
| 42 | 0.054 | 0.01 | 0.46 | 0.010 | 0.0039 | 0.054 | 0.0195 | 0.061 | 0.035 | tr. | tr. | tr. | Comparative Example |
| 43 | 0.065 | 0.01 | 0.54 | 0.009 | 0.0075 | 0.046 | 0.0043 | 0.174 | 0.029 | tr. | tr. | tr. | Comparative Example |
| 44 | 0.072 | 0.02 | 0.29 | 0.013 | 0.0056 | 0.027 | 0.0039 | 0.157 | 0.038 | tr. | tr. | tr. | Comparative Example |
| 45 | 0.033 | 0.02 | 0.53 | 0.014 | 0.0018 | 0.035 | 0.0041 | 0.004 | 0.054 | tr. | tr. | tr. | Comparative Example |

NOTE:
Underlines indicate outside range according to present disclosure.

TABLE 2

| Steel sheet No. | Steel No. | Heating temperature (° C.) | Finish rolling temperature (° C.) | Coiling temperature (° C.) | Cooling rate after coiling (° C./h) | Hot-rolled sheet thickness (mm) | Rolling reduction in primary cold rolling (%) | Heating rate (° C./s) | Soaking temperature (° C.) | Soaking holding time (s) |
|---|---|---|---|---|---|---|---|---|---|---|
| 1 | 1 | 1210 | 885 | 690 | 36 | 2.3 | 91 | 23 | 710 | 36 |
| 2 | 2 | 1205 | 890 | 645 | 29 | 2.0 | 91 | 9 | 685 | 84 |
| 3 | 3 | 1230 | 880 | 705 | 41 | 2.6 | 92 | 36 | 690 | 41 |
| 4 | 4 | 1215 | 875 | 660 | 37 | 2.3 | 90 | 12 | 675 | 73 |
| 5 | 5 | 1210 | 890 | 725 | 53 | 2.0 | 90 | 18 | 705 | 56 |
| 6 | 6 | 1235 | 855 | 650 | 26 | 1.8 | 88 | 47 | 650 | 62 |
| 7 | 7 | 1220 | 910 | 710 | 38 | 1.8 | 87 | 11 | 745 | 25 |
| 8 | 8 | 1240 | 860 | 665 | 42 | 1.8 | 90 | 39 | 695 | 47 |
| 9 | 9 | 1250 | 905 | 740 | 35 | 1.7 | 86 | 20 | 715 | 32 |
| 10 | 10 | 1215 | 890 | 685 | 50 | 1.7 | 88 | 26 | 700 | 29 |
| 11 | 11 | 1220 | 885 | 700 | 44 | 1.7 | 88 | 24 | 680 | 43 |
| 12 | 12 | 1235 | 870 | 670 | 39 | 1.9 | 90 | 41 | 715 | 54 |
| 13 | 13 | 1205 | 890 | 655 | 52 | 1.9 | 90 | 28 | 670 | 68 |
| 14 | 14 | 1200 | 885 | 660 | 28 | 2.8 | 93 | 19 | 710 | 17 |
| 15 | 15 | 1225 | 900 | 705 | 34 | 1.7 | 87 | 25 | 705 | 39 |
| 16 | 16 | 1210 | 885 | 750 | 47 | 2.0 | 89 | 32 | 690 | 24 |

TABLE 2-continued

| | | | | | | | | | | |
|---|---|---|---|---|---|---|---|---|---|---|
| 17 | 17 | 1205 | 870 | 665 | 31 | 1.8 | 89 | 27 | 705 | 53 |
| 18 | 18 | 1270 | 905 | 650 | 29 | 3.0 | 92 | 39 | 725 | 85 |
| 19 | 19 | 1245 | 880 | 750 | 46 | 2.3 | 91 | 14 | 655 | 19 |
| 20 | 20 | 1285 | 880 | 675 | 40 | 2.1 | 91 | 28 | 680 | 46 |
| 21 | 21 | 1225 | 890 | 730 | 33 | 1.8 | 88 | 22 | 705 | 25 |
| 22 | 22 | 1240 | 885 | 650 | 43 | 1.8 | 90 | 46 | 730 | 41 |
| 23 | 23 | 1215 | 905 | 705 | 37 | 1.8 | 90 | 17 | 670 | 37 |
| 24 | 24 | 1230 | 935 | 680 | 52 | 2.0 | 89 | 33 | 705 | 50 |
| 25 | 25 | 1220 | 895 | 695 | 44 | 2.3 | 91 | 26 | 690 | 28 |
| 26 | 26 | 1235 | 890 | 675 | 35 | 2.1 | 90 | 19 | 720 | 35 |
| 27 | 27 | 1230 | 895 | 690 | 39 | 2.0 | 90 | 24 | 715 | 43 |
| 28 | 28 | 1240 | 895 | 665 | 37 | 2.1 | 91 | 18 | 695 | 29 |
| 29 | 29 | 1225 | 900 | 670 | 42 | 2.0 | 90 | 29 | 705 | 37 |
| 30 | 30 | 1235 | 905 | 685 | 34 | 2.0 | 90 | 31 | 720 | 42 |
| 31 | 31 | 1215 | 880 | 675 | 39 | 2.3 | 91 | 21 | 700 | 24 |
| 32 | 32 | 1205 | 860 | 690 | 40 | 2.0 | 89 | 48 | 680 | 57 |
| 33 | 33 | 1200 | 885 | 715 | 31 | 1.8 | 89 | 25 | 715 | 30 |
| 34 | 34 | 1215 | 870 | 665 | 46 | 1.8 | 87 | 37 | 705 | 26 |
| 35 | 35 | 1240 | 385 | 750 | 35 | 1.7 | 86 | 12 | 730 | 63 |
| 36 | 36 | 1235 | 910 | 720 | 29 | 2.3 | 90 | 46 | 655 | 42 |
| 37 | 37 | 1250 | 880 | 705 | 31 | 2.6 | 92 | 31 | 690 | 37 |
| 38 | 38 | 1225 | 880 | 685 | 37 | 2.8 | 93 | 37 | 710 | 84 |
| 39 | 39 | 1205 | 905 | 705 | 50 | 2.5 | 91 | 24 | 715 | 21 |
| 40 | 40 | 1230 | 890 | 690 | 33 | 2.3 | 89 | 29 | 690 | 57 |
| 41 | 41 | 1210 | 900 | 675 | 29 | 2.0 | 89 | 46 | 705 | 65 |
| 42 | 42 | 1245 | 875 | 700 | 48 | 2.0 | 90 | 18 | 715 | 59 |
| 43 | 43 | 1220 | 905 | 660 | 32 | 1.8 | 88 | 35 | 685 | 73 |
| 44 | 44 | 1255 | 895 | 695 | 49 | 1.8 | 90 | 37 | 700 | 36 |
| 45 | 45 | 1290 | 905 | 710 | 34 | 1.9 | 88 | 23 | 715 | 24 |

| Steel sheet No. | Rolling reduction in secondary cold rolling (%) | Finish sheet thickness (mm) | Ti*/C | Proportion of cementite in ferrite grains (%) | Upper yield strength in rolling direction (MPa) | Corrosion resistance | Wrinkling of curl portion | Remarks |
|---|---|---|---|---|---|---|---|---|
| 1 | 2.3 | 0.20 | 0.423 | 3 | 623 | Excellent | Not wrinkled | Example |
| 2 | 1.5 | 0.18 | 0.112 | 8 | 664 | Excellent | Not wrinkled | Example |
| 3 | 6.7 | 0.19 | 0.649 | 1 | 591 | Excellent | Not wrinkled | Example |
| 4 | 3.1 | 0.22 | 0.239 | 5 | 645 | Excellent | Not wrinkled | Example |
| 5 | 5.6 | 0.19 | 0.314 | 4 | 584 | Excellent | Not wrinkled | Example |
| 6 | 0.8 | 0.21 | 0.043 | 8 | 651 | Good | Not wrinkled | Example |
| 7 | 6.4 | 0.22 | 0.195 | 2 | 567 | Excellent | Not wrinkled | Example |
| 8 | 1.9 | 0.18 | 0.202 | 4 | 593 | Excellent | Not wrinkled | Example |
| 9 | 4.7 | 0.23 | 0.076 | 3 | 576 | Excellent | Not wrinkled | Example |
| 10 | 5.3 | 0.19 | 0.402 | 5 | 564 | Excellent | Not wrinkled | Example |
| 11 | 6.2 | 0.19 | 0.237 | 4 | 579 | Excellent | Not wrinkled | Example |
| 12 | 8.5 | 0.17 | 0.311 | 6 | 602 | Excellent | Not wrinkled | Example |
| 13 | 7.8 | 0.18 | 0.194 | 6 | 615 | Excellent | Not wrinkled | Example |
| 14 | 14.6 | 0.17 | 0.160 | 1 | 553 | Excellent | Not wrinkled | Example |
| 15 | 6.1 | 0.21 | 0.050 | 3 | 576 | Excellent | Not wrinkled | Example |
| 16 | 5.9 | 0.21 | 0.008 | 8 | 571 | Excellent | Not wrinkled | Example |
| 17 | 9.4 | 0.18 | 0.083 | 4 | 568 | Excellent | Not wrinkled | Example |
| 18 | 11.7 | 0.21 | 0.177 | 6 | 556 | Excellent | Not wrinkled | Example |
| 19 | 9.5 | 0.19 | 0.214 | 3 | 574 | Excellent | Not wrinkled | Example |
| 20 | 3.8 | 0.18 | 0.241 | 5 | 562 | Excellent | Not wrinkled | Example |
| 21 | 8.2 | 0.20 | 0.115 | 4 | 576 | Excellent | Not wrinkled | Example |
| 22 | 1.4 | 0.18 | 0.539 | 6 | 595 | Excellent | Not wrinkled | Example |
| 23 | 4.6 | 0.17 | 0.031 | 8 | 573 | Excellent | Not wrinkled | Example |
| 24 | 5.3 | 0.21 | 0.336 | 4 | 649 | Excellent | Not wrinkled | Example |
| 25 | 7.8 | 0.19 | 0.046 | 7 | 606 | Excellent | Not wrinkled | Example |
| 26 | 3.0 | 0.20 | 0.170 | 5 | 614 | Excellent | Not wrinkled | Example |
| 27 | 5.1 | 0.19 | 0.230 | 3 | 522 | Excellent | Not wrinkled | Example |
| 28 | 4.8 | 0.18 | 0.198 | 8 | 518 | Excellent | Not wrinkled | Example |
| 29 | 2.9 | 0.19 | 0.180 | 6 | 604 | Excellent | Not wrinkled | Example |
| 30 | 3.4 | 0.19 | 0.152 | 7 | 595 | Excellent | Not wrinkled | Example |
| 31 | 0.2 | 0.21 | 0.004 | 13 | 537 | Excellent | Wrinkled | Comparative Example |
| 32 | 1.9 | 0.22 | 0.067 | 12 | 513 | Excellent | Wrinkled | Comparative Example |
| 33 | 5.7 | 0.19 | 0.235 | 9 | 507 | Excellent | Not wrinkled | Comparative Example |
| 34 | 4.4 | 0.22 | 0.315 | 8 | 514 | Excellent | Not wrinkled | Comparative Example |
| 35 | 13.6 | 0.21 | 1.192 | 2 | 431 | Excellent | Wrinkled | Comparative Example |
| 36 | 9.0 | 0.21 | 0.200 | 3 | 458 | Excellent | Not wrinkled | Comparative Example |
| 37 | 6.8 | 0.19 | 0.105 | 5 | 571 | Poor | Not wrinkled | Comparative Example |
| 38 | 0.5 | 0.20 | 0.132 | 16 | 562 | Poor | Wrinkled | Comparative Example |
| 39 | 6.2 | 0.21 | 0.269 | 6 | 475 | Excellent | Not wrinkled | Comparative Example |
| 40 | 2.9 | 0.25 | 0.129 | 8 | 693 | Poor | Wrinkled | Comparative Example |
| 41 | 8.7 | 0.20 | 0.245 | 7 | 538 | Excellent | Not wrinkled | Comparative Example |
| 42 | 9.5 | 0.18 | 0.255 | 8 | 516 | Excellent | Not wrinkled | Comparative Example |

TABLE 2-continued

| | | | | | | | | | |
|---|---|---|---|---|---|---|---|---|---|
| | 43 | 7.1 | 0.20 | 0.798 | 6 | 614 | Excellent | Wrinkled | Comparative Example |
| | 44 | 5.3 | 0.17 | 0.516 | 0 | 591 | Excellent | Wrinkled | Comparative Example |
| | 45 | 1.9 | 0.22 | 0.002 | 12 | 457 | Excellent | Wrinkled | Comparative Example |

NOTE:
Underlines indicate outside range according to present disclosure.

TABLE 3

| Steel sheet No. | Steel No. | Heating temperature (° C.) | Finish rolling temperature (° C.) | Coiling temperature (° C.) | Cooling rate after coiling (° C./h) | Hot-rolled sheet thickness (mm) | Rolling reduction in primary cold rolling (%) | Heating rate (° C./s) | Soaking temperature (° C.) | Soaking holding time (s) |
|---|---|---|---|---|---|---|---|---|---|---|
| 46 | 3 | 1090 | 890 | 705 | 43 | 2.1 | 90 | 19 | 690 | 43 |
| 47 | 3 | 1225 | 905 | 680 | 35 | 2.1 | 90 | 24 | 705 | 31 |
| 48 | 3 | 1210 | 780 | 695 | 19 | 2.0 | 90 | 33 | 675 | 22 |
| 49 | 3 | 1230 | 880 | 610 | 32 | 2.0 | 91 | 25 | 680 | 35 |
| 50 | 3 | 1230 | 900 | 690 | 47 | 2.3 | 91 | 16 | 720 | 47 |
| 51 | 12 | 1215 | 910 | 710 | 29 | 1.9 | 90 | 31 | 710 | 20 |
| 52 | 12 | 1205 | 885 | 840 | 36 | 2.0 | 90 | 27 | 685 | 34 |
| 53 | 12 | 1200 | 905 | 670 | 44 | 2.0 | 88 | 32 | 650 | 19 |
| 54 | 12 | 1235 | 865 | 715 | 12 | 1.8 | 88 | 9 | 670 | 84 |
| 55 | 12 | 1250 | 915 | 700 | 37 | 2.3 | 91 | 39 | 680 | 17 |
| 56 | 12 | 1220 | 895 | 690 | 28 | 1.7 | 84 | 45 | 690 | 12 |
| 57 | 13 | 1255 | 900 | 675 | 34 | 2.3 | 92 | 18 | 685 | 76 |
| 58 | 13 | 1245 | 875 | 740 | 41 | 2.5 | 92 | 32 | 730 | 38 |
| 59 | 13 | 1270 | 860 | 660 | 85 | 2.0 | 90 | 40 | 700 | 18 |
| 60 | 13 | 1230 | 870 | 705 | 50 | 2.0 | 90 | 29 | 690 | 33 |
| 61 | 13 | 1220 | 880 | 685 | 38 | 1.8 | 87 | 2 | 725 | 79 |
| 62 | 13 | 1225 | 925 | 690 | 26 | 2.0 | 90 | 14 | 670 | 65 |
| 63 | 13 | 1255 | 890 | 705 | 45 | 1.8 | 86 | 28 | 695 | 46 |
| 64 | 18 | 1240 | 860 | 770 | 30 | 2.5 | 93 | 73 | 760 | 14 |
| 65 | 18 | 1205 | 895 | 725 | 53 | 2.0 | 90 | 20 | 615 | 51 |
| 66 | 18 | 1275 | 910 | 675 | 37 | 2.1 | 91 | 36 | 690 | 3 |
| 67 | 24 | 1210 | 915 | 680 | 29 | 2.3 | 92 | 18 | 830 | 46 |
| 68 | 24 | 1245 | 875 | 690 | 42 | 2.0 | 89 | 23 | 705 | 39 |
| 69 | 24 | 1215 | 880 | 705 | 36 | 2.2 | 90 | 37 | 685 | 126 |
| 70 | 24 | 1235 | 880 | 700 | 39 | 2.0 | 90 | 31 | 670 | 28 |
| 71 | 24 | 1220 | 890 | 690 | 40 | 2.0 | 90 | 28 | 675 | 34 |
| 72 | 34 | 1235 | 915 | 645 | 38 | 2.3 | 91 | 33 | 710 | 30 |
| 73 | 34 | 1220 | 895 | 685 | 43 | 2.6 | 93 | 17 | 690 | 73 |
| 74 | 34 | 1255 | 905 | 705 | 52 | 3.4 | 93 | 50 | 685 | 13 |
| 75 | 34 | 1230 | 870 | 725 | 31 | 2.5 | 92 | 35 | 705 | 47 |
| 76 | 34 | 1270 | 890 | 670 | 13 | 2.5 | 92 | 39 | 745 | 40 |
| 77 | 43 | 1240 | 875 | 690 | 40 | 1.8 | 88 | 1 1 | 715 | 68 |
| 78 | 43 | 1225 | 910 | 660 | 39 | 1.8 | 89 | 27 | 670 | 37 |
| 79 | 45 | 1245 | 870 | 715 | 32 | 2.0 | 89 | 72 | 685 | 19 |
| 80 | 45 | 1205 | 855 | 680 | 84 | 2.0 | 90 | 36 | 700 | 41 |

| Steel sheet No. | Rolling reduction in secondary cold rolling (%) | Finish sheet thickness (mm) | Ti*/C. | Proportion of cementite in ferrite grains (%) | Upper yield strength in rolling direction (MPa) | Corrosion resistance | Wrinkling of curl portion | Remarks |
|---|---|---|---|---|---|---|---|---|
| 46 | 4.2 | 0.20 | 0.649 | 8 | 563 | Excellent | Wrinkled | Comparative Example |
| 47 | 3.6 | 0.20 | 0.649 | 2 | 603 | Excellent | Not wrinkled | Example |
| 48 | 1.9 | 0.20 | 0.649 | 6 | 574 | Excellent | Wrinkled | Comparative Example |
| 49 | 5.3 | 0.17 | 0.649 | 13 | 565 | Excellent | Wrinkled | Comparative Example |
| 50 | 4.8 | 0.20 | 0.649 | 3 | 597 | Excellent | Not wrinkled | Example |
| 51 | 2.2 | 0.19 | 0.311 | 5 | 606 | Excellent | Not wrinkled | Example |
| 52 | 5.1 | 0.19 | 0.311 | 9 | 485 | Excellent | Not wrinkled | Comparative Example |
| 53 | 4.8 | 0.23 | 0.311 | 6 | 589 | Excellent | Not wrinkled | Example |
| 54 | 1.5 | 0.21 | 0.311 | 15 | 512 | Excellent | Wrinkled | Comparative Example |
| 55 | 6.4 | 0.19 | 0.311 | 6 | 574 | Excellent | Not wrinkled | Example |
| 56 | 13.1 | 0.24 | 0.311 | 5 | 517 | Excellent | Not wrinkled | Comparative Example |
| 57 | 5.3 | 0.17 | 0.194 | 4 | 595 | Excellent | Not wrinkled | Example |
| 58 | 10.6 | 0.18 | 0.194 | 5 | 603 | Excellent | Not wrinkled | Example |
| 59 | 7.9 | 0.18 | 0.194 | 1 | 634 | Excellent | Wrinkled | Comparative Example |
| 60 | 4.6 | 0.19 | 0.194 | 6 | 612 | Excellent | Not wrinkled | Example |
| 61 | 8.7 | 0.21 | 0.194 | 00 | 508 | Excellent | Not wrinkled | Comparative Example |
| 62 | 6.6 | 0.19 | 0.194 | 5 | 616 | Excellent | Not wrinkled | Example |

TABLE 3-continued

| | | | | | | | | |
|---|---|---|---|---|---|---|---|---|
| 63 | 7.0 | 0.23 | 0.194 | 4 | 604 | Excellent | Not wrinkled | Example |
| 64 | 0.3 | 0.17 | 0.177 | 6 | 613 | Excellen | Wrinkled | Comparative Example |
| 65 | 4.8 | 0.19 | 0.177 | 8 | 568 | Excellent | Wrinkled | Comparative Example |
| 66 | 9.5 | 0.17 | 0.177 | 5 | 562 | Excellent | Wrinkled | Comparative Example |
| 67 | 0.9 | 0.18 | 0.336 | 5 | 504 | Excellent | Not wrinkled | Comparative Example |
| 68 | 2.4 | 0.21 | 0.336 | 4 | 637 | Excellent | Not wrinkled | Example |
| 69 | 3.7 | 0.21 | 0.336 | 7 | 521 | Excellent | Not wrinkled | Comparative Example |
| 70 | 5.2 | 0.19 | 0.336 | 5 | 625 | Excellent | Not wrinkled | Example |
| 71 | 0.04 | 0.20 | 0.336 | 5 | 524 | Excellent | Not wrinkled | Comparative Example |
| 72 | 4.8 | 0.20 | 0.336 | 7 | 536 | Excellent | Not wrinkled | Comparative Example |
| 73 | 2.3 | 0.18 | 0.315 | 8 | 542 | Excellent | Not wrinkled | Comparative Example |
| 74 | 23.7 | 0.18 | 0.315 | 8 | 687 | Excellent | Wrinkled | Comparative Example |
| 75 | 8.6 | 0.18 | 0.315 | 7 | 535 | Excellent | Not wrinkled | Comparative Example |
| 76 | 5.9 | 0.19 | 0.315 | 14 | 541 | Excellent | Wrinkled | Comparative Example |
| 77 | 9.2 | 0.20 | 0.798 | 9 | 534 | Excellent | Wrinkled | Comparative Example |
| 78 | 1.7 | 0.19 | 0.798 | 7 | 592 | Excellent | Wrinkled | Comparative Example |
| 79 | 7.4 | 0.20 | 0.002 | 13 | 483 | Excellent | Wrinkled | Comparative Example |
| 80 | 4.9 | 0.19 | 0.002 | 12 | 519 | Excellent | Wrinkled | Comparative Example |

NOTE:
Underlines indicate outside range according to present disclosure.

INDUSTRIAL APPLICABILITY

It is thus possible to obtain a steel sheet for cans that has high strength and has sufficiently high working accuracy particularly as a material of a curl portion of a can lid. Since the steel sheet for cans has high uniform deformability, for example in the case of working a can lid, a can lid product with high working accuracy can be produced. Such a steel sheet for cans is optimal mainly for use in, for example, a three-piece can produced using can body working with a large amount of deformation, a two-piece can produced by working a bottom portion in several %, and a can lid.

The invention claimed is:

1. A steel sheet for cans, comprising:

a chemical composition containing, in mass %, C: 0.010% or more and 0.130% or less, Si: 0.04% or less, Mn: 0.10% or more and 1.00% or less, P: 0.007% or more and 0.100% or less, S: 0.0005% or more and 0.0090% or less, Al: 0.001% or more and 0.100% or less, N: 0.0050% or less, Ti: 0.0050% or more and 0.1000% or less, and Cr: 0.08% or less, and satisfying a relationship $0.005 \leq (Ti^*/48)/(C/12) \leq 0.700$ where $Ti^* = Ti - 1.5S$, with a balance including Fe and inevitable impurities;

a microstructure in which a proportion of cementite in ferrite grains is 10% or less; and an upper yield strength of 550 MPa or more.

2. The steel sheet for cans according to claim 1, wherein the chemical composition further contains, in mass %, one or more selected from Nb: 0.0050% or more and 0.0500% or less, Mo: 0.0050% or more and 0.0500% or less, and B: 0.0020% or more and 0.0100% or less.

* * * * *